US008641368B1

(12) United States Patent
Liang

(10) Patent No.: US 8,641,368 B1
(45) Date of Patent: Feb. 4, 2014

(54) INDUSTRIAL TURBINE BLADE WITH PLATFORM COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 418 days.

(21) Appl. No.: 13/013,196

(22) Filed: Jan. 25, 2011

(51) Int. Cl.
*F01D 5/18* (2006.01)

(52) U.S. Cl.
USPC ..... 415/115; 416/193 A

(58) Field of Classification Search
USPC ..... 416/248, 239, 193 A, 189, 95, 96 R, 97 R
See application file for complete search history.

(56) References Cited

U.S. PATENT DOCUMENTS 4,872,812 A * 10/1989 Hendley et al. ..... 416/190
5,281,097 A * 1/1994 Wilson et al. ..... 416/193 A
5,284,421 A * 2/1994 Chlus et al. ..... 416/248
5,415,526 A * 5/1995 Mercadante et al. ..... 416/190
6,017,189 A * 1/2000 Judet et al. ..... 416/97 R
6,120,249 A * 9/2000 Hultgren et al. ..... 416/97 R
6,196,799 B1 * 3/2001 Fukue et al. ..... 416/97 R
6,341,939 B1 * 1/2002 Lee ..... 416/97 R
6,457,935 B1 * 10/2002 Antunes et al. ..... 415/115
2006/0024164 A1 * 2/2006 Keith et al. ..... 416/97 R
2006/0093484 A1 * 5/2006 Liang ..... 416/193 A
2006/0269409 A1 * 11/2006 Torii et al. ..... 416/97 R
2007/0134099 A1 * 6/2007 Lee et al. ..... 416/193 A
2007/0201979 A1 * 8/2007 Veltre et al. ..... 416/97 R
2009/0202339 A1 * 8/2009 Torii et al. ..... 415/115
2010/0232975 A1 * 9/2010 Morris et al. ..... 416/232

* cited by examiner

*Primary Examiner* — Nathaniel Wiehe
*Assistant Examiner* — Wayne A Lambert
(74) *Attorney, Agent, or Firm* — John Ryznic

(57) ABSTRACT

A turbine rotor blade with a platform hot spot cooling circuit that includes a bracket occupying a space below the platform on the pressure side of the blade neck and forming a cooling air supply hole connected to the blade cooling air supply channel and opening into an impingement cavity located below a hot spot location on the pressure side platform surface. A number of film cooling holes are connected to the impingement cavity and open onto the platform surface to cool the hot spot location.

10 Claims, 5 Drawing Sheets

INDUSTRIAL TURBINE BLADE WITH PLATFORM COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to an industrial gas turbine engine turbine blade with platform cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

The cooling of the blade platform in an industrial gas turbine engine is produced using convection cooling or film cooling. In the convection cooled platform, straight cooling holes formed within the platform with long length-to-diameter ratios are used. FIGS. 1 and 2 show this prior art blade platform cooling design using convection cooling holes. FIGS. 3 and 4 show the prior art blade platform cooling design using film cooling holes. The blade includes an airfoil section 11 extending from a platform 12 and a root section 13 with a cooling air supply channel 16. In FIG. 3, the platform is cooled using a number of film cooling holes 15 connected to a dead rim cavity 14 formed below the platform 12. In FIG. 2, the platform convection cooling holes are supplied from the cooling air supply channel 16.

The blade platform cooling designs of FIGS. 1 through 4 have several important design issues. Providing film cooling air for the entire blade platform requires a cooling air supply pressure from the dead rim cavity 14 to be higher than the peak blade platform external gas side pressure. This design induces a high leakage flow around the blade attachment region 13 and therefore causes a performance penalty. Using the long length-to-diameter ratio convection cooling holes that are drilled from the platform edge to the airfoil cooling supply channel 16 from the blade platform produces unacceptable stress levels at the airfoil cooling core and the platform cooling channels interface location, which therefore yields a low blade life. This problem is primary due to the large mass at the front and back ends of the blade root or attachment 13 which constrains the blade platform expansion. The cooling channels are also oriented transverse to the primary direction of the stress field which produces high stress concentrations in the cooling channels at the entrance location. Also, drilling the long cooling holes 23 along the platform axial length from the side will not cover the local hot spot 25 on the blade pressure side platform identified in FIG. 5 because of the angled cooling holes 22 on the suction side surface.

FIG. 5 shows a prior art turbine blade platform cooling circuit with long length-to-diameter cooling channels 21 on the suction side that feed smaller cooling channels 22 that branch off at an angle, and several long length-to-diameter cooling channels 23 that extend along the pressure side surface of the platform and that are parallel. These cooling channels are supplied from a dead rim cavity located below the platform and discharge onto the aft side edge of the platform.

BRIEF SUMMARY OF THE INVENTION

An industrial turbine rotor blade with a platform cooling circuit that includes a bracket located below the platform and on the pressure side of the blade neck that forms a cooling air supply hole and impingement cavity to provide cooling for an underside of the platform on the pressure side where a hot spot is located. Cooling air from the blade cooling supply channel is bled off into the bracket cooling supply hole and impinged into the platform impingement cavity to provide cooling for the platform underside. The spent impingement cooling air is then discharged onto the platform pressure side surface as film cooling air for additional platform cooling.

The bracket occupies space within the dead rim cavity so that less pressurized cooling air is required in the dead rim cavity. The bracket also increases the convection surface area for cooling of the platform.

DETAILED DESCRIPTION OF THE INVENTION

Figure 1:
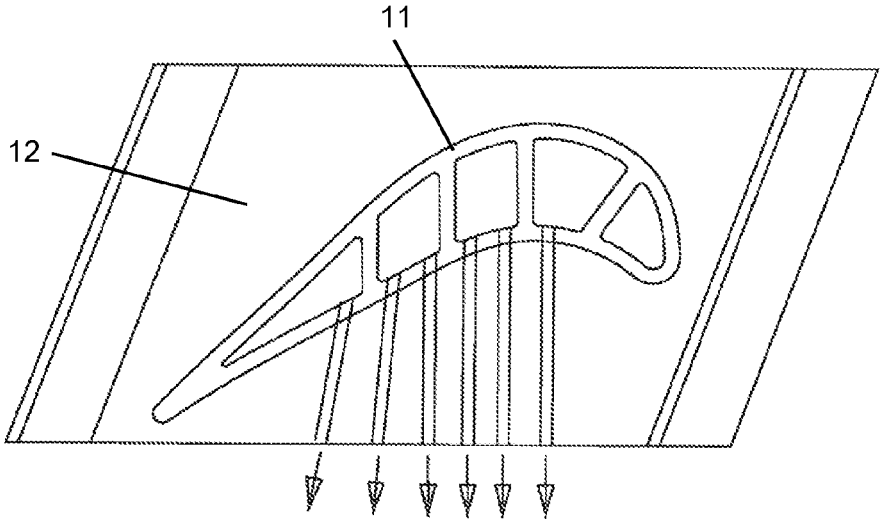
FIG 1 prior art
FIG. 1 shows a cross section top view of a prior art blade with platform convection cooling holes.
Figure 2:
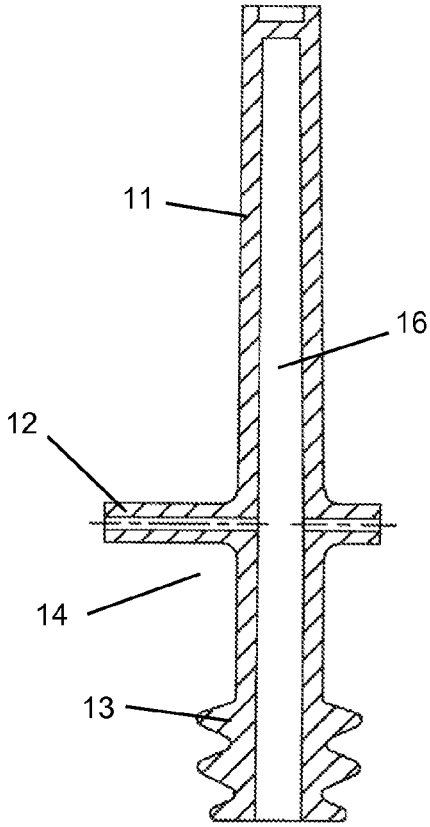
FIG 2 prior art
FIG. 2 shows a cross section side view of the FIG. 1 blade with convection cooling holes in the platform.
Figure 3:
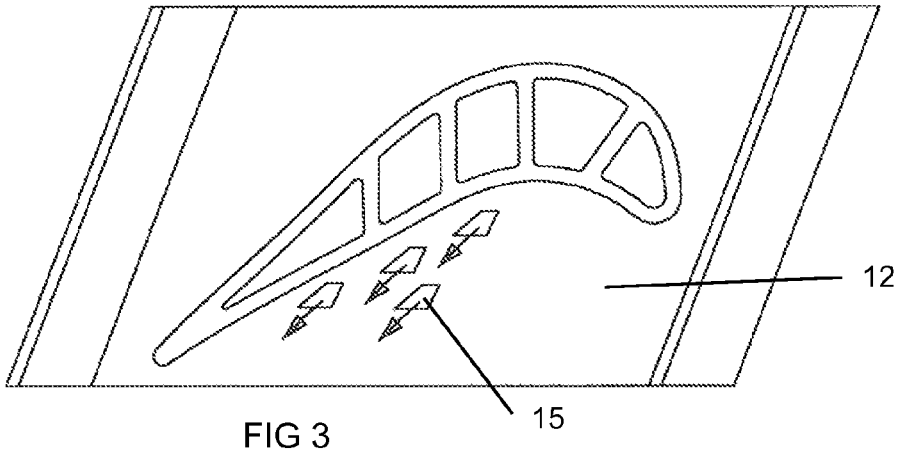
FIG 3 prior art
FIG. 3 shows a cross section top view of a prior art blade with platform film cooling holes.
Figure 4:
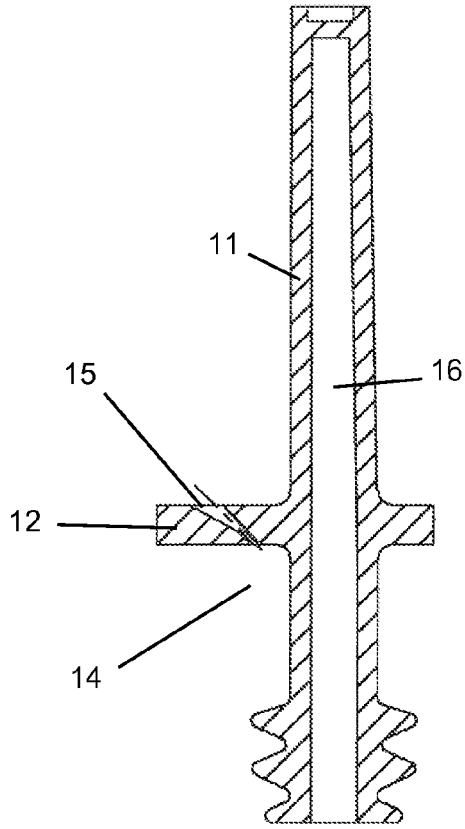
FIG 4 prior art
FIG. 4 shows a cross section side view of the FIG. 3 blade with film cooling holes in the platform.
Figure 5:
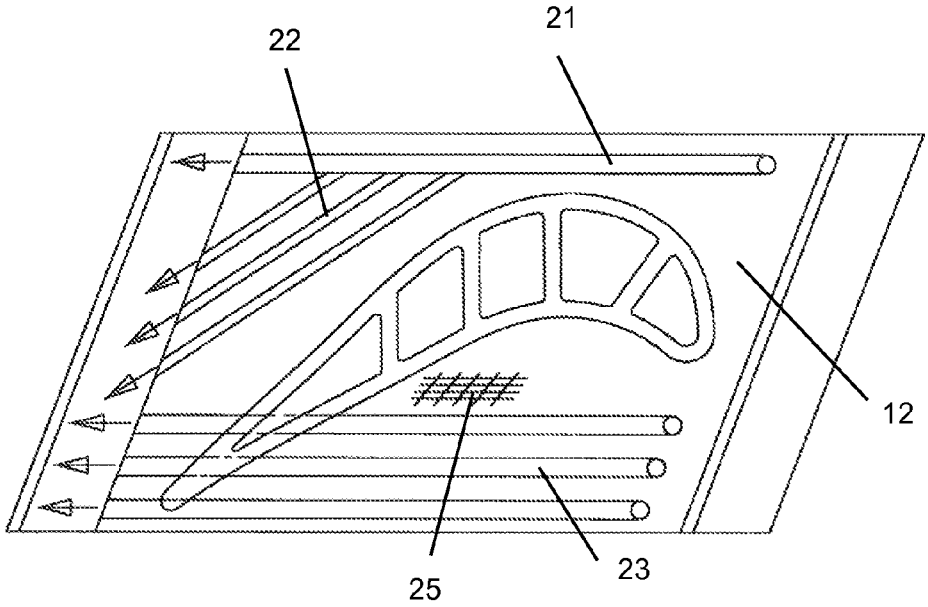
FIG 5 prior art
FIG. 5 shows a cross section top view of a blade with platform cooling holes of the prior art with a hot spot location on the pressure side surface of the platform not covered by any of the cooling holes.
Figure 6:
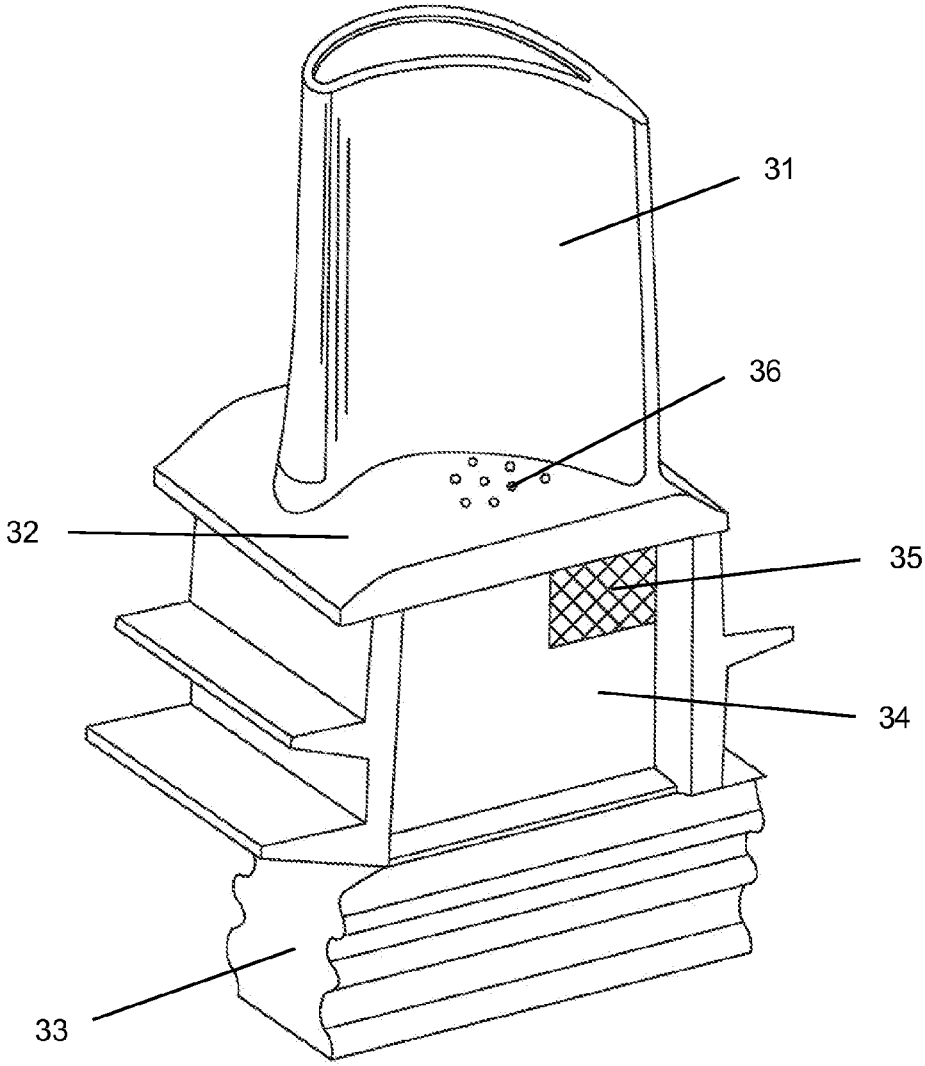
FIG. 6 shows a profile view of the blade of the present invention with the film cooling holes located on the hot spot of the prior art blade.

A turbine rotor blade in a large frame heavy duty industrial gas turbine engine of the first stage includes a platform cooling circuit that provides cooling to an area on the blade where hot spots were found to occur in the prior art blades. FIG. 6 shows a profile view of the blade and includes an airfoil 31 extending from a platform 32, and a root 33 and a blade neck 34 extending from the platform 32 to form a blade attachment. An arrangement of film cooling holes 36 open on to the platform surface on the pressure side of the airfoil. A cooled bracket structure 35 is located below the platform on the pressure side of the neck 34 that forms a cooling air supply cavity and metering supply holes for the film cooling holes 36.

Figure 7:
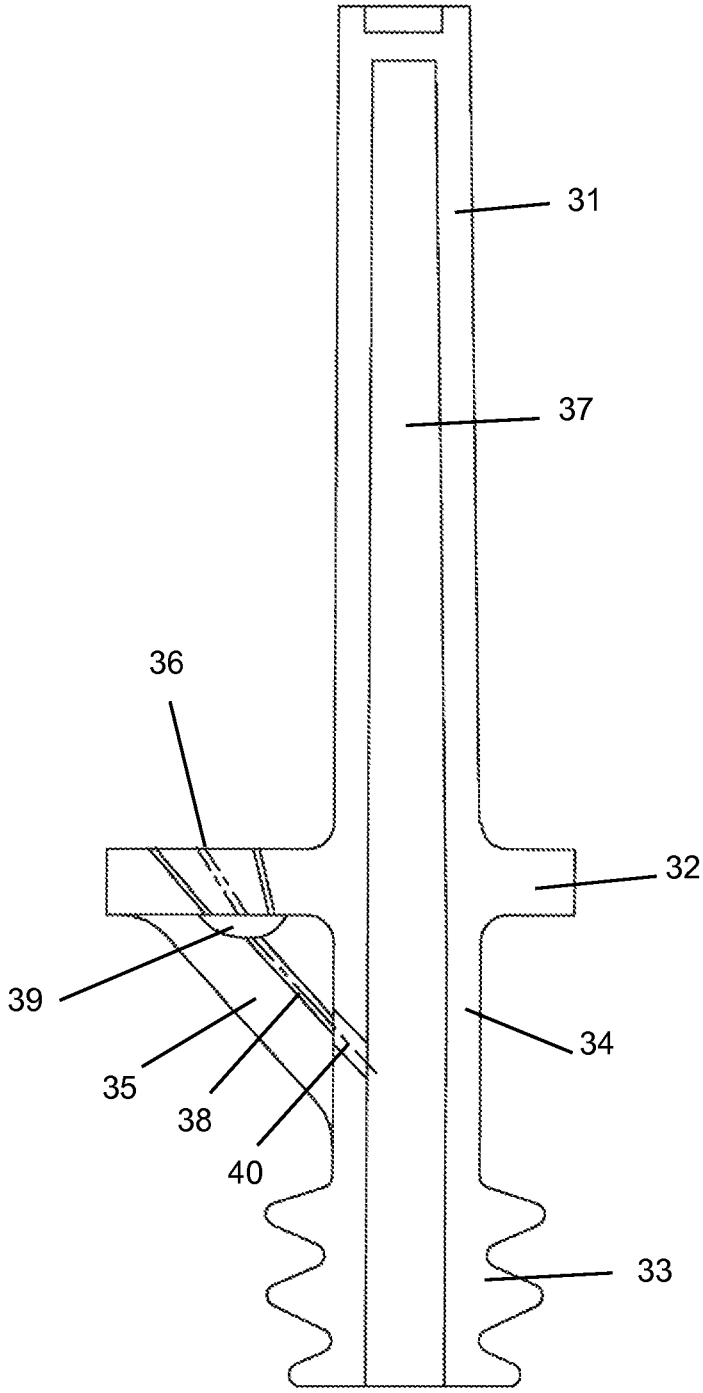
FIG. 7 shows a cross section side view of the blade of the present invention with the platform cooling circuit formed within a bracket secured to the blade attachment region.

FIG. 7 shows a cross section of the blade with the cooled bracket structure 35 attached to or formed as part of the pressure side of the neck 34 underneath the platform 32. A cooling air supply channel 37 is formed within the blade and extends from the root to the blade tip to supply cooling air to all passages within the blade. The cooled bracket 35 includes one or more cooling air supply holes 38 connected to the cooling air supply channel 37 and opens into an impingement cavity 39 formed under the platform 32. The film cooling holes 36 are connected to the impingement cavity 39 and discharge film cooling air from the impingement cavity 39.

In operation, cooling air supplied to the cooling air supply channel 37 is bled off into the bracket cooling supply hole 38 and discharged into the impingement cavity 39 to produce impingement cooling to the underside of the platform where the hot spot is located. The cooling air supply channel 37 is connected to the bracket cooling supply hole 38 through a larger diameter cooling supply hole 40 formed in the blade neck section 34. Hole 40 is larger than hole 38 so that any shifting of the bracket 35 will not cause any hole to be partially blocked. In this embodiment, one hole 40 opens into one hole 38 formed in the bracket 35. However, other arrangements with more than one hole for each can be used without departing from the spirit and scope of the present invention. The spent impingement cooling air in the impingement cavity 39 is then discharged as film cooling air from the film cooling holes 36 onto the hot surface of the platform where the hot spot is located. The cold bracket 35 will conduct heat away from the platform 32 and also retain the cooling air within the impingement cavity.

Major design features and advantages of the platform cooling circuit of the present invention are described below. The cooled bracket structure can be cast under the platform in the dead rim cavity. The cooling channel or channels can be formed within the bracket depending upon the platform cooling requirements. The cooled bracket is formed with a tapered angle in a radial outward direction from the blade neck to the platform. The cooled bracket will also function as a support structure for the platform.

The use of an additional bracket structure increases the conduction area at the platform to the blade neck interface. This increases the fin efficiency for the platform extended surface and therefore results in a more effective heat conduction from the platform edge to the airfoil core and a cooler blade platform performance.

The additional bracket structure also increases the overall convection surface area for the blade platform which results in a lower platform mass average temperature and reduces a thermal gradient.

Use of the bracket structure with the cooling passage and impingement cavity for the platform local hot spot reduces the volume of the dead rim cavity and therefore lowers the required volume of pressurized cooling air within the dead rim cavity.

Directed cooling of the blade platform local hot spot is achieved with the use of the cooled bracket structure. The bracket structure also provides additional strength for the cooling bleed hole at the blade neck location.

I claim the following:

1. An industrial engine turbine rotor blade comprising:
an airfoil extending from a platform and a root with a neck formed between the platform and the root;
the airfoil having a pressure side wall and a suction side wall;
a cooling air supply channel passing through the blade from the root to a blade tip;
a bracket located under a pressure side of the platform and covering a section of an underside of the platform and a section of the pressure side of the neck;
the bracket having a cooling air supply hole extending from the neck to the platform that connects to the cooling air supply channel and an impingement cavity formed under the platform;
the cooling air supply hole within the bracket is directed to produce impingement cooling to an underside of the platform; and,
a plurality of film cooling holes connected to the bracket impingement cavity and opening onto a surface of the platform on the pressure side.

2. The turbine rotor blade of claim 1, and further comprising:
the bracket is formed as a separate piece and bonded to the blade.

3. The turbine rotor blade of claim 1, and further comprising:
the film cooling holes open onto a hot spot location of the platform.

4. An industrial engine turbine rotor blade comprising:
an airfoil extending from a platform and a root with a neck formed between the platform and the root;
the airfoil having a pressure side wall and a suction side wall;
a cooling air supply channel passing through the blade from the root to a blade tip;
a bracket located under a pressure side of the platform and covering a section of an underside of the platform and a section of the pressure side of the neck;
the bracket having a cooling air supply hole extending from the neck to the platform that connects to the cooling air supply channel and an impingement cavity formed under the platform;
a plurality of film cooling holes connected to the bracket impingement cavity and opening onto a surface of the platform on the pressure side; and,
the bracket includes an outer surface that is slanted toward a rim cavity.

5. The turbine rotor blade of claim 1, and further comprising:
the impingement cavity is of such a size to cover an entire underside of a hot spot located on the platform.

6. An industrial engine turbine rotor blade comprising:
an airfoil extending from a platform and a root with a neck formed between the platform and the root;
the airfoil having a pressure side wall and a suction side wall;
a cooling air supply channel passing through the blade from the root to a blade tip;
a bracket located under a pressure side of the platform and covering a section of an underside of the platform and a section of the pressure side of the neck;
the bracket having a cooling air supply hole connected to the cooling air supply channel and an impingement cavity formed under the platform;

a plurality of film cooling holes connected to the bracket impingement cavity and opening onto a surface of the platform on the pressure side;

a first cooling air supply hole is formed within the blade neck and opens into the second cooling air supply hole formed within the bracket; and, the first cooling air supply hole is of larger diameter than the second cooling air supply hole within the bracket so that shifting of the bracket will not partially block the second cooling air supply hole.

7. An industrial engine turbine rotor blade comprising:

an airfoil extending from a root and a platform;

a cooling air supply channel formed within the root and the airfoil;

a cooling bracket secured to an underside of the platform on a pressure side of the blade and to a side of a neck of the blade;

the cooling bracket having a cooling air supply hole extending from the neck to the platform that connects to the cooling air supply channel;

the cooling bracket having an impingement cavity connected to the cooling air supply hole to produce impingement cooling to an underside of the platform on the pressure side of the blade;

the cooling bracket being mostly a solid piece such that heat is conducted away from the platform and to the neck; and, the platform having a plurality of film cooling holes opening onto a section of the platform where a hot spot occurs and connected to the impingement cavity of the cooling bracket.

8. The turbine rotor blade of claim 7, and further comprising:

the bracket is formed as a separate piece and bonded to the blade.

9. The turbine rotor blade of claim 7, and further comprising:

the impingement cavity is of such a size to cover an entire underside of a hot spot located on the platform.

10. An industrial engine turbine rotor blade comprising:

an airfoil extending from a root and a platform;

a cooling air supply channel formed within the root and the airfoil;

a cooling bracket secured to an underside of the platform on a pressure side of the blade and to a side of a neck of the blade;

the cooling bracket having a cooling air supply hole connected to the cooling air supply channel;

the cooling bracket having an impingement cavity connected to the cooling air supply hole to produce impingement cooling to an underside of the platform on the pressure side of the blade;

the platform having a plurality of film cooling holes opening onto a section of the platform where a hot spot occurs and connected to the impingement cavity of the cooling bracket;

a first cooling air supply hole is formed within the blade neck and opens into the second cooling air supply hole formed within the bracket; and, the first cooling air supply hole is of larger diameter than the second cooling air supply hole within the bracket so that shifting of the bracket will not partially block the second cooling air supply hole.

* * * * *